United States Patent [19]

Koschade

[11] Patent Number: 5,033,529

[45] Date of Patent: Jul. 23, 1991

[54] PANEL FABRIC FASTENING SYSTEM

[75] Inventor: Karl A. Koschade, Plattsburgh, N.Y.

[73] Assignee: Biltrite Nightingale Interiors, Inc., Montreal, Canada

[21] Appl. No.: 554,926

[22] Filed: Jul. 20, 1990

[51] Int. Cl.[5] ..... A47G 5/00

[52] U.S. Cl. ..... 160/398; 160/371; 160/404; 38/102.91; 38/102; 38/102.1; 24/459

[58] Field of Search ..... 160/398, 380, 378, 371, 160/328, 404; 38/102, 102.1, 102.2, 102.3, 102.4, 102.5, 102.6, 102.7, 102.8, 102.9, 102.91; 52/222, 63, 83, 511, 239; 24/459–462

[56] References Cited

U.S. PATENT DOCUMENTS

| | | | |
|---|---|---|---|
| 584,148 | 6/1897 | Robinson | 160/398 |
| 1,726,703 | 9/1929 | Inglis | 160/398 |
| 2,217,389 | 2/1938 | Steger | 52/511 X |
| 3,308,598 | 3/1967 | Wilson | 52/511 |
| 3,763,918 | 10/1973 | Clark | 160/404 X |
| 3,841,008 | 10/1974 | Cusick | 38/102.91 |
| 3,871,153 | 3/1975 | Birum | 52/239 X |
| 4,151,665 | 5/1979 | Gibby | 160/404 X |
| 4,549,334 | 10/1985 | Miller | 24/459 X |
| 4,878,531 | 11/1989 | Stover | 160/404 X |

*Primary Examiner*—Blair M. Johnson
*Assistant Examiner*—Korie H. Chan
*Attorney, Agent, or Firm*—H. Jay Spiegel

[57] ABSTRACT

A panel fabric fastening system is disclosed which includes fastening devices mounted along the edges of the panel, each of which includes a plurality of pointed elements. Fabric is stretched over the panel and is engaged by the pointed elements to retain the fabric in a stretched position over the sides of the panel. A cap device may be installed over the fastening devices to cover the ends of the fabric and provide an aesthetic finish. The fastening devices may be easily installed and removed.

14 Claims, 2 Drawing Sheets

PANEL FABRIC FASTENING SYSTEM

BACKGROUND OF THE INVENTION

The present invention relates to a panel fabric fastening system. In the prior art, fastening devices having pointed elements are known. The following United States Patents and foreign references are known to Applicant:

Robinson U.S. Pat. No. 584,148
Porter U.S. Pat. No. 1,212,676
Frazer U.S. Pat. No. 2,417,922
Abadjieff U.S. Pat. No. 3,166,117
Schneider U.S. Pat. No. 3,181,598
Wilson U.S. Pat. No. 3,308,598
Sperling U.S. Pat. No. 3,785,426
Tombu U.S. Pat. No. 3,822,734
Gibby U.S. Pat. No. 4,151,665
Walker U.S. Pat. No. 4,248,022
Stover U.S. Pat. No. 4,878,531
Belgian Patent No. 541,836 to Reggiani
French Patent No. 854,244 to Riffat
French Patent No. 1,186,436 to Steiner Each of the above listed documents teaches a fastening device having some pointed elements designed to allow fastening of a fabric or screen thereto. Of the above listed documents, Robinson and Frazer teach the use of a cap device designed to cover the pointed elements, while Riffat teaches installation of the fastening devices in a sliding action. None of these references, taken alone or in combination with any of the other references, is believed to fairly teach the environment of contemplated use of the present invention as well as all of the structure and function thereof.

SUMMARY OF THE INVENTION

The present invention relates to a panel fabric fastening system. The present invention includes the following interrelated aspects and features:

(A) In a first aspect, the environment of contemplated use of the present invention comprises a panel intended to be used as a room divider, wall section, or other construction device. The panel as finally assembled is intended to have a small thickness as compared to its length and width, with the panel defining two large faces covered with fabric.

(B) The panel has a peripheral edge separating the two large faces thereof, with the peripheral edge having a groove extending circumferentially of the panel. The groove is shown in the drawings as a dovetail groove. However, such configuration is merely exemplary and the groove may be made in any desired configuration, preferably including an internal width larger than an opening thereof.

(C) Fastening devices are fastened to the panel with one edge thereof engaging one wall of the groove and with another edge engaging the intersection of one large face of the panel and the adjacent region of the peripheral edge thereof. In the preferred embodiment of the present invention, two such fastening devices are provided which are mirror images of one another, with the second fastening device engaging another wall of the groove with one edge thereof and with another edge thereof engaging the intersection of another one of the large faces of the panel and the adjacent region of the peripheral edge of the panel.

(D) Each of the fastening devices includes a plurality of pointed elements which are angled generally in the direction of the groove. Each large face of the panel has fabric stretched thereover and extending over the peripheral edge of the panel to be engaged by the pointed elements of the fastening device adjacent to that particular large face. With the fabric stretched over a panel face and fastened using the pointed elements as explained, the portions of the fabric beyond the pointed elements may be trimmed, whereupon a cap device may be installed over the edges of the fabric and the fastening devices for aesthetic purposes.

(E) The fastening devices may be easily removed from the panel, should it be desirable to change the fabric or for any other desired purpose.

Accordingly, it is a first object of the present invention to provide an improved panel fabric fastening system.

It is a further object of the present invention to provide such a system including fastening devices having pointed elements, which fastening devices may be removably fastened to peripheral edges of the panel.

It is a still further object of the present invention to provide such a device wherein a cap device may be used to cover the fastening devices for aesthetic purposes.

It is a yet further object of the present invention to provide such a system which may be easily installed on a panel and which may be easily removed therefrom.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
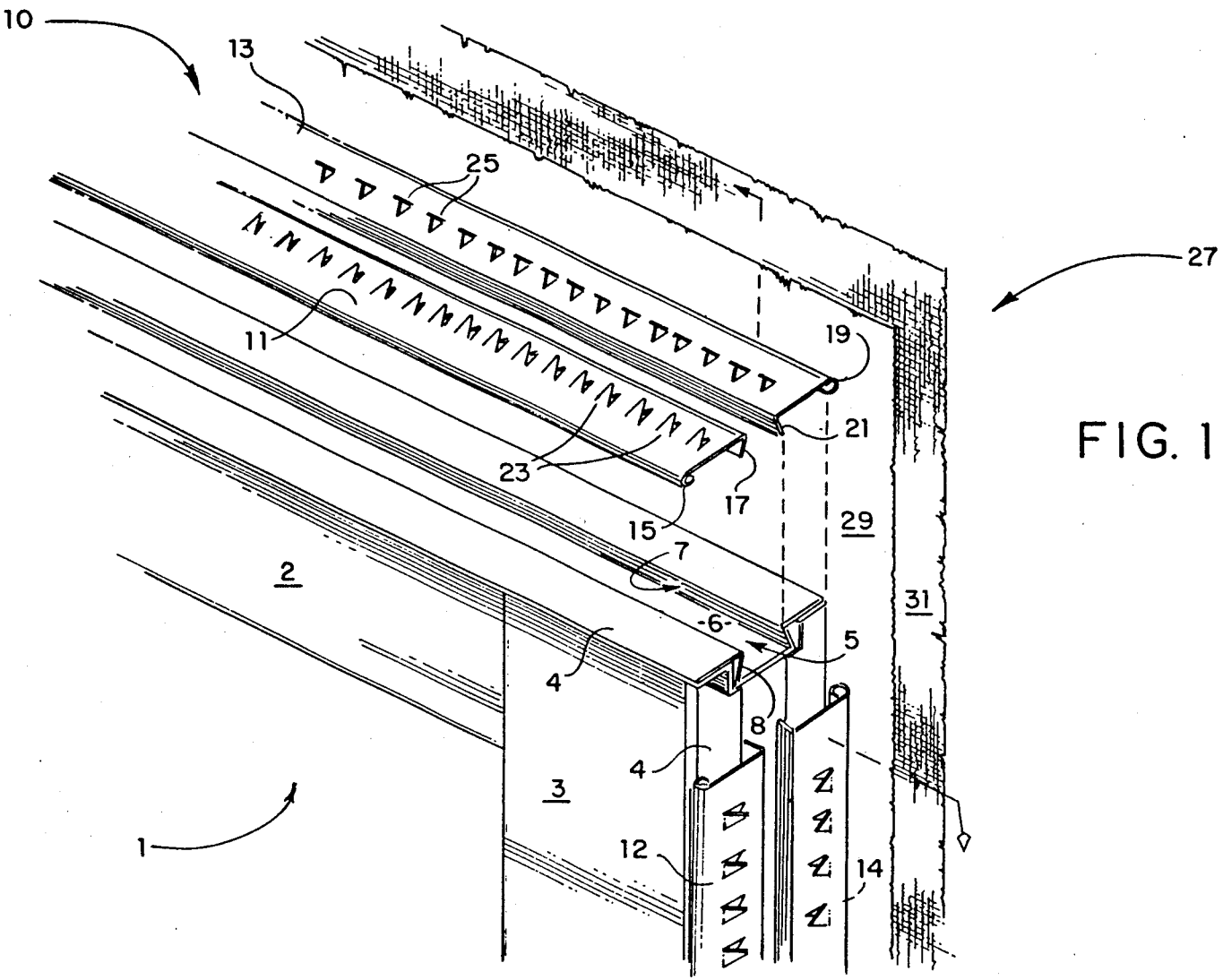
FIG. 1 shows an exploded perspective view of the present invention.

With reference, first, to FIG. 1, a panel is generally designed by the reference numeral 1 and is seen to include sections 2 and 3 assembled together in any suitable manner along with other similar sections (not shown), as well as assembled to the edge sections 4 to form a panel.

In the preferred embodiment of the present invention, the sections 2, 3 and 4 are made of a sheet metal and are spotwelded together. If desired, a soundproofing material may be installed within the frame to reduce sound transmission, with fiberglass being a preferred material for such purpose.

Figure 2:
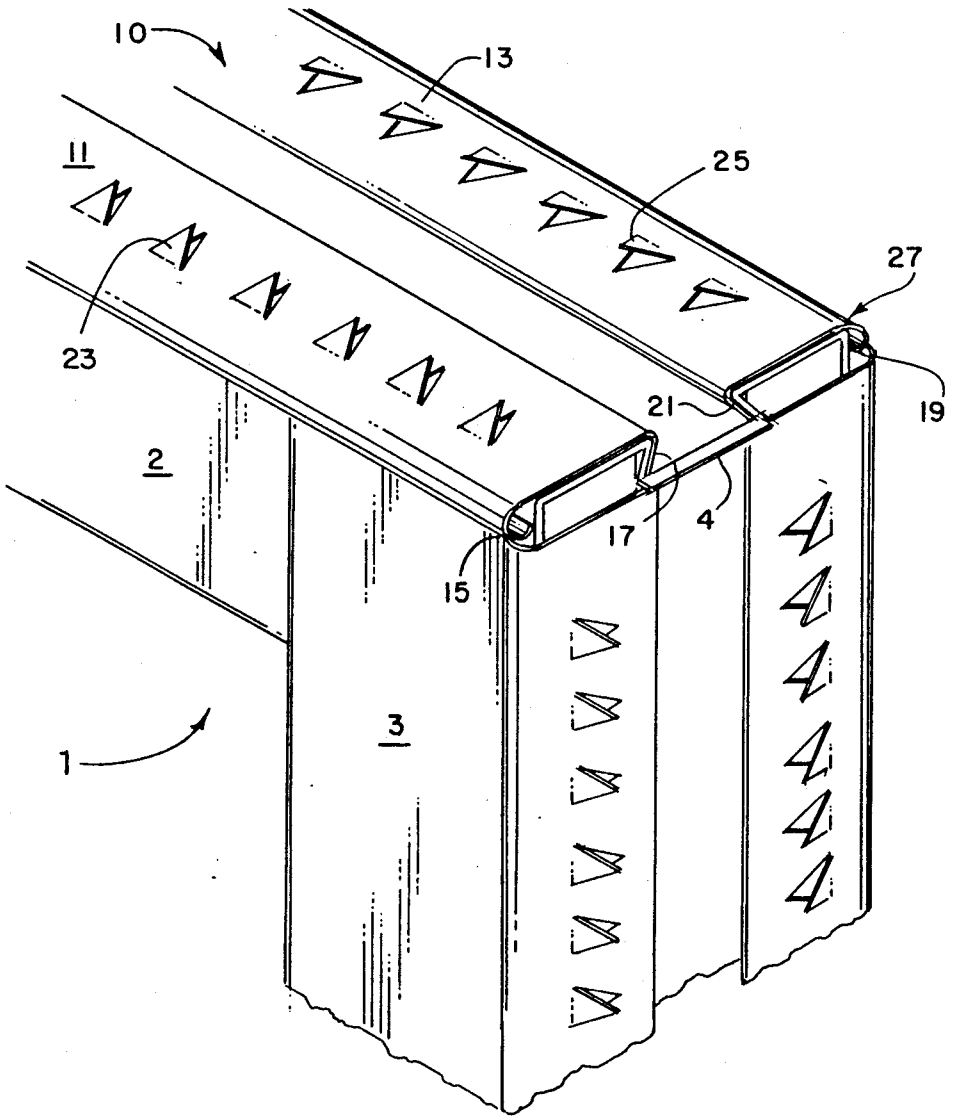
FIG. 2 shows a perspective view similar to that of FIG. 1, but with the various structures of the panel and inventive system assembled together.

As shown in FIGS. 1 and 2, the peripheral edge section 4 includes a groove 5 including a bottom wall 6 and side walls 7, 8 which angle toward one another from the bottom wall 6 upwardly. While the groove is shown in the Figures as a dovetail groove, this is merely exemplary. The groove may be made in any desired configuration, preferably including an internal width larger than an opening thereof. The sections 2 and 3 are provided with internal structure designed to fixedly receive the peripheral edge sections 4 in assembled relation with fastening means such as, gluing, welding, fastening with fasteners such as nuts and bolts being examples of the manner of assembly of the panel 1.

With further reference to FIGS. 1 and 2, the inventive panel fabric fastening system is generally designated by the reference numeral 10 and is seen to include fastening devices 11, 12, 13 and 14.

The fastening device 11 is seen to include one end 15 curved about itself to provide a spring-like element and another end 17 which is angled in a manner conforming to the angulation of the wall 8 of the peripheral edge section 4. The fastening device 11 includes a plurality of upstanding points 23, which are angled in a direction toward the center of the peripheral edge section 4.

The fastening device 13 is, in essence, a mirror image of the fastening deviced 11, and includes one end 19 which is curved about itself to form a spring-like element and another end 21 which is angled in a manner conforming to the degree of angulation of the wall 7 of the peripheral edge section 4. The fastening device 13 includes a plurality of pointed elements 25, which are angled in a direction toward the center of the peripheral edge section 4 and also obliquely face the pointed elements 23 of the fastening device 11.

The fastening devices 11, 13 may be easily assembled to the panel 1 for use in fastening fabric 27 thereover. In this regard, for example, with reference to the fastening device 11, the fastening device 11 may be fastened to the panel 1 by first inserting the end 17 into the groove 5 of the peripheral edge section 4 with the end 17 engaging the wall 8 thereof, whereupon the fastening device 11 may be pivoted until the end 15 engages over the panel 1 at an intersection of the wall thereof formed by the sections 2, 3 and the termination of the peripheral edge section 4 in the manner shown in FIG. 2. The spring-like nature of the end 15 of the fastening device 11 facilitates retention of the fastening device 11 thereover with such spring action forcing the end 17 against the wall 8 of the groove 5 of the peripheral edge section 4, thereby retaining the fastening device 11 in assembled position.

The fastening device 13 is assembled to the panel 1 in a similar manner, with the end 21 thereof first being inserted against the wall 7 of the groove 5, whereupon the fastening device 13 may be pivoted until the end 19 engages over the wall of the panel 1 with the spring action of the end 19 retaining the fastening device 13 in assembled relation.

With the fastening devices 11 and 13 being so assembled on the panel 1, and with other fastening devices such as those designated by the reference numerals 12 and 14 being similarly assembled thereon, the fabric 27 having a large flat portion 29 and edge portions 31 may be assembled over the panel 1 using the fastening devices 13 and 14 as well as other fastening devices on other regions thereof (not shown). A similar piece of fabric may be assembled over the fastening devices 11, 12, as well as other fastening devices (not shown) to complete assembly of the panel 1 into a finished product.

In this regard, the edges 31 of the fabric 27 may be stretched over the fastening devices 13, 14 and, with particular reference to the fastening device 13, such stretching of the edges 31 may be followed by pressing down of the edges 31 into the pointed elements 25 to cause the pointed elements to pierce the fabric, as shown in FIG. 2. With the fabric 27 so stretched over the panel, and with the pointed elements 25 piercing the fabric edges 31, the fabric is maintained over the panel in a stretched configuration. In such configuration, further forces are generated in a direction toward the edges of the panel which will cause the fastening device 13 to be maintained in assembled relation thereover due to the angled relationship of the end 21 of the fastening device 13 as interacting with the wall 7 of the peripheral edge section 4 thereof.

In a similar way, as stated above, a piece of fabric is assembled over fastening devices such as the fastening devices 11, 12 to thereby complete assembly of fabric over the panel 1.

Thereafter, terminating edges of the edges 31 of the fabric 27 assembled over the fastening devices 11, 12 may be trimmed at a region thereof closer to the groove 5 of the peripheral edge section 4 than the location of the pointed elements 25, 23 in order to provide neatness at that location. Thereafter, with reference to FIG. 3, an elongated cap 30 may be assembled over the fastening devices 11, 13 to provide aesthetic function.

Figure 3:
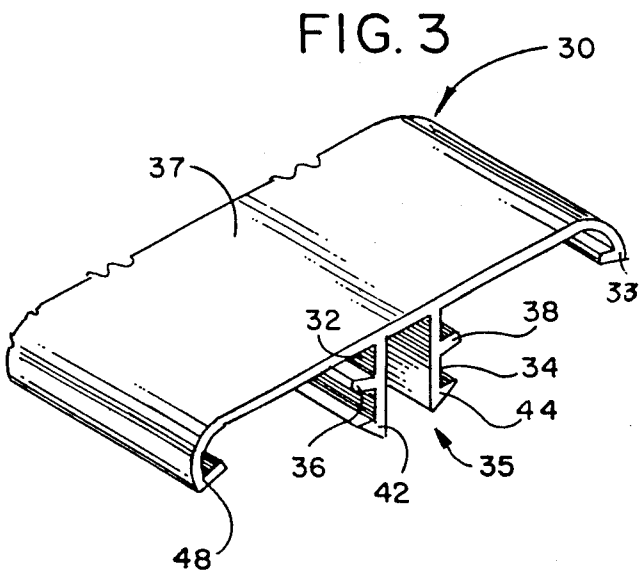
FIG. 3 shows a perspective view of a cap forming a part of the present invention.

With reference to FIG. 3, the cap 30 is seen to include a top surface 37 as well as peripheral edges 48, 33 and a retainer 35 including two ribs 32, 34 having respective side projections 36, 38 and respective ends 42, 44 of substantially triangular cross-section. In the preferred embodiment of the use of the cap 30, the cap 30 may be clipped with the retainer projection 35 entering the groove 5 to further lock the fastening devices 11, 13 in assembled relation while covering the pointed elements 23, 25 thereof and providing an aesthetic appearance. In such configuration, the peripheral edges 48, 33 of the cap 30 cover the ends 15, 19 of the respective fastening devices 11, 13 to further aesthetic effect.

Of course, similar caps 30 are provided on all peripheral edges of the panel 1 so that the aesthetic effect is provided throughout.

In the preferred embodiment of the present invention, the cap 30 is made of a material such as flexible plastic or rubber which has sufficient flexibility to allow flexing of the peripheral edges 48 and 33 thereof during assembly. The cap 30 may be made in any suitable color compatible with the color of the fabric 27, or may be made of decorative wood molding material.

In a further aspect, the fastening devices 11 and 13 as well as other fastening devices used in conjunction with the present invention may be made of a thin metallic material which, in a preferred embodiment, may comprise spring steel to provide the required flexibility and resiliency in the ends 15, 19 of the fastening devices 11, 13. The fastening devices may be manufactured using any conventional techniques such as roll forming to form the edges of the fastening devices and punching to form the pointed elements.

If wear occurs on the fabric 27 or, for any other reason, it is desired to change the fabric 27, in accordance with the teachings of the present invention, it is quite easy to disassemble the fabric 27 from the panel 1. In so doing, one must first remove the caps 30 from over the fastening devices, whereupon the fabric 27 may be stretched toward the dovetail groove 5 thereof, thereby allowing disengagement of the fabric 27 from the pointed elements of the fastening devices. In such a way, the fabric 27 may easily be removed from the panel 1. Thereafter, one may inspect the fastening devices 11, 13 and the other fastening devices mounted on the panel 1 to see if any damage or corrosion has occurred therein. If desired, the fastening devices may easily be removed from the panel and may be replaced. An example of the manner of removal of a fastening device from the panel 1 is explained with reference to the fastening device 11, with particular reference to FIG. 2. The fastening device 11 may easily be removed from the panel 1 by pivoting the end 15 thereof upwardly and away from the intersection of the edge of the panel formed by the sections 2, 3 on the one hand and 4 on the other hand. Such pivoting will allow disengagement of the end 17 of the fastening device 11 from the wall 8 of the dovetail groove 5 of the peripheral edge section 4 thereof, whereupon the fastening device 11 may easily be removed therefrom and may be replaced. In a similar way, any of the other fastening devices used in conjunction with the teachings of the present invention may be as easily removed therefrom.

As such, an invention has been disclosed in terms of a preferred embodiment thereof which fulfills each and every one of the objects of the invention as set forth hereinabove and provides a new and improved panel fabric fastening system which greatly improves upon the prior art in versatility and flexibility as well as ease of assembly and disassembly.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In a panel having at least one face, a peripheral edge section adjacent said face and a groove in said edge section, the improvement comprising a fastening system for fastening a piece of fabric over said face comprising:

(a) a fastening device removably attached over said panel edge section between said groove and said face, said fastening device having a plurality of pointed element extending outwardly therefrom and including an elongated side portion overlying said face adjacent said edge section; and (b) a piece of fabric stretched over said face and said elongated side portion and pierced by said pointed elements.

2. The invention of claim 1, wherein said pointed elements are angled toward said groove.

3. The invention of claim 1, wherein said panel has two faces with said edge section separating said faces, and further including a fastening device for each said face, each fastening device having a further side portion entering said groove.

4. The invention of claim 3, wherein each said fastening device elongated side portion comprises a resiliently biased curved portion engaging its respective face to hold said fastening devices in assembled position.

5. The invention of claim 1, further including a cap adapted to be assembled over said edge section to aesthetically cover said fastening device.

6. The invention of claim 4, further including a cap adapted to be assembled over said edge section to aesthetically cover said fastening devices.

7. The invention of claim 6, wherein said cap includes a protruding retainer adapted to enter said groove

8. The invention of claim 1, wherein said fastening device is made of a metallic material.

9. The invention of claim 8, wherein said cap is made of plastic, rubber or wood.

10. A fastening device comprising:

(a) an elongated substantially flat body having a longitudinal extent and having first and second sides attached thereto at least one of said sides extending away from a lateral edge of said body in a first direction;

(b) a plurality of upstanding pointed elements on said elongated body extending in a second direction generally opposite said first direction;

(c) said first side comprising an elongated substantially continuous curved resilient biasing means and said second side comprising elongated substantially continuous fastening means angularly related to said elongated body.

11. The invention of claim 10, wherein said fastening device is made of a metallic material.

12. The invention of claim 11, wherein said metallic material is steel.

13. The invention of claim 10, wherein said fastening means further comprises an elongated first face which forms an acute angle with respect to said elongated body, said first face being adapted to engage an adjacent structure.

14. The invention of claim 10, wherein said resilient biasing means further comprises a substantially cylindrically shaped portion, said substantially cylindrically shaped portion being adapted to engage an adjacent surface by compression of said substantially cylindrically shaped portion.

* * * * *